US005307882A

United States Patent [19]

Launiemi

[11] Patent Number: 5,307,882

[45] Date of Patent: May 3, 1994

[54] APPARATUS FOR FEEDING A DRILLING MACHINE IN EXTENSION ROD DRILLING

[75] Inventor: Markku Launiemi, Tampere, Finland

[73] Assignee: Tamrock Oy, Tampere, Finland

[21] Appl. No.: 965,369

[22] PCT Filed: Jun. 11, 1991

[86] PCT No.: PCT/FI91/00184

§ 371 Date: Dec. 17, 1992

§ 102(e) Date: Dec. 17, 1992

[87] PCT Pub. No.: WO91/19885

PCT Pub. Date: Dec. 26, 1991

[30] Foreign Application Priority Data

Jun. 15, 1990 [FI] Finland ..... 903026

[51] Int. Cl.[5] ..... E21C 5/11

[52] U.S. Cl. ..... 173/152

[58] Field of Search ..... 173/206, 152, 164, 34, 173/37; 175/87, 422

[56] References Cited

U.S. PATENT DOCUMENTS

| | | | |
|---|---|---|---|
| 2,910,049 | 10/1959 | Calder | 121/46 |
| 3,220,494 | 11/1965 | Cannon et al. | 173/152 |
| 3,454,114 | 7/1969 | Poage | 173/152 |
| 3,554,298 | 1/1971 | Klein | 173/164 |
| 3,695,363 | 10/1972 | Kelly, Jr. | 173/152 |
| 3,797,587 | 3/1974 | Klein | 173/152 |
| 3,857,451 | 12/1974 | Williams | 173/152 |
| 4,757,866 | 7/1988 | Szoke | 173/152 |

FOREIGN PATENT DOCUMENTS

| | | |
|---|---|---|
| 852051 | 5/1985 | Finland . |
| 311130 | 7/1968 | Sweden . |

*Primary Examiner*—Scott Smith
*Attorney, Agent, or Firm*—Nixon & Vanderhye

[57] ABSTRACT

A feeding apparatus for a rock drilling machine (8). The feeding apparatus comprises a feeding cylinder (5) movable with respect to the feeding apparatus and a connecting cylinder (6) arranged around the feeding cylinder (5) movably in its longitudinal direction. To add a new drill pipe to a drill string, the drilling machine (8) is displaced by means of the connecting cylinder (6) and during the drilling movement by means of the feeding cylinder (5).

2 Claims, 2 Drawing Sheets

APPARATUS FOR FEEDING A DRILLING MACHINE IN EXTENSION ROD DRILLING

BACKGROUND OF THE INVENTION

The invention relates to an apparatus for feeding a rock drilling machine in extension rod drilling, comprising at least one feeding cylinder and a piston provided with a two-sided piston rod, and pressure fluid conduits for feeding pressure fluid into pressure fluid spaces in the feeding cylinder and away therefrom, the feeding cylinder being mounted in the feeding apparatus in such a way that the piston is longitudinally immovable with respect to the feeding apparatus and the feeding cylinder is movable in the feeding direction with respect to the piston; a second piston immovable in the longitudinal direction of the feeding cylinder and a separate connecting cylinder displaceable in the longitudinal direction of the feeding cylinder with respect to the second piston and the feeding cylinder, said second piston and said connecting cylinder being arranged around the feeding cylinder; and pressure fluid conduits separate from the pressure fluid conduits of the feeding cylinder for feeding pressure fluid into the pressure fluid spaces in the connecting cylinder to the different sides of the second piston for displacing the connecting cylinder with respect on feeding cylinder, the drilling machine being connected to the connecting cylinder.

In long-hole or extension rod drilling, several drill rods or pipes are attached to each other in succession to achieve the desired drill hole length. Successive drill rods or pipes are interconnected by means of threads. In order to add a new drill rod or pipe, the drilling machine is detached from the preceding drill rods and the new rod is positioned therebetween and fastened by rotating the drilling machine. In the prior art arrangements the drilling machine is displaced by the same feeding device both during the drilling process and when attaching or detaching drill rods or pipes. The feeding device displaces the drilling machine in a desired direction, depending on whether a new rod is to be attached to or detached from the drill string. A problem therewith is that the length of the displacing movement cannot be adjusted when closing or opening threads as there are no provisions for such adjustment. One well-known solution to the problem is to use various sensors which detect the movements of the drilling machine with respect to the feeding beam. In automatic and computer-controlled drilling in particular, the required sensing operations cause extra work in terms of control and required connections in order to ensure successful drilling. Long-hole drilling equipments generally comprise a hydraulic telescope cylinder provided with a rod or pipe fixed in the direction of travel of the drilling machine, a displacing cylinder connected to the drilling machine being movable on this rod or pipe. It is known to use in the feeding apparatus telescopically interconnected displacing cylinders comprising several superimposed cylinders so connected that they all move simultaneously when pressure fluid is fed. This kind of arrangement is known from SE Published Specification 311130, which discloses two different embodiments of the telescope cylinder. In these embodiments, the drilling machine is displaced in its longitudinal direction by feeding pressure fluid through one feed conduit into cylinder spaces within the structure of the telescope cylinder, so that all the cylinders move simultaneously, whereby the cylinder construction is extended, or when pressure fluid is fed into the other pressure fluid conduit, the cylinder construction is shortened.

A similar arrangement is disclosed in FI Patent Application 852051, in which two cylinders are positioned one upon the other on a fixed arm. When pressure fluid is fed through pressure fluid conduits formed in the fixed arm and conduits formed in the cylinders, both cylinders move simultaneously in either direction, depending on through which end of the fixed arm the pressure fluid is fed.

SUMMARY OF THE PRESENT INVENTION

The object of the present invention is to provide a feeding apparatus which enables both the drilling machine to be displaced and returned during drilling and the treads to be closed and opened in a simple and easy way. This is achieved according to the invention in such a way that total movement length of the connecting cylinder is at least two times the thread length of the extension rods and that the connecting cylinder comprises an additional pressure fluid conduit positioned substantially in the middle of the movement length of the connecting cylinder for stopping the movement of the connecting cylinder when the second piston reaches said pressure fluid conduit.

The basic idea of the invention is that the cylinder arrangement of the feeding apparatus comprises a separate feeding cylinder which is surrounded by a separate connecting cylinder, so that the feeding movement is realized by means of the feeding cylinder and the thread is closed or opened by means of the connecting cylinder. In this way the control of the drilling machine during the different steps is simple and easy and does not require any complicated and expensive sensing means and associated additional control connections, which are sometimes unreliable in difficult conditions.

BRIEF DESCRIPTION OF THE DRAWING FIGURES

The invention will be described in greater detail with reference to the attached drawings, in which FIG. 1 is a sectional view of the cylinder arrangement of a feeding apparatus according to the invention; and FIGS. 2*a* to 2*e* illustrate schematically the different operational steps of the feeding apparatus according to the invention.

DESCRIPTION OF A PREFERRED EMBODIMENT

Figure 1:
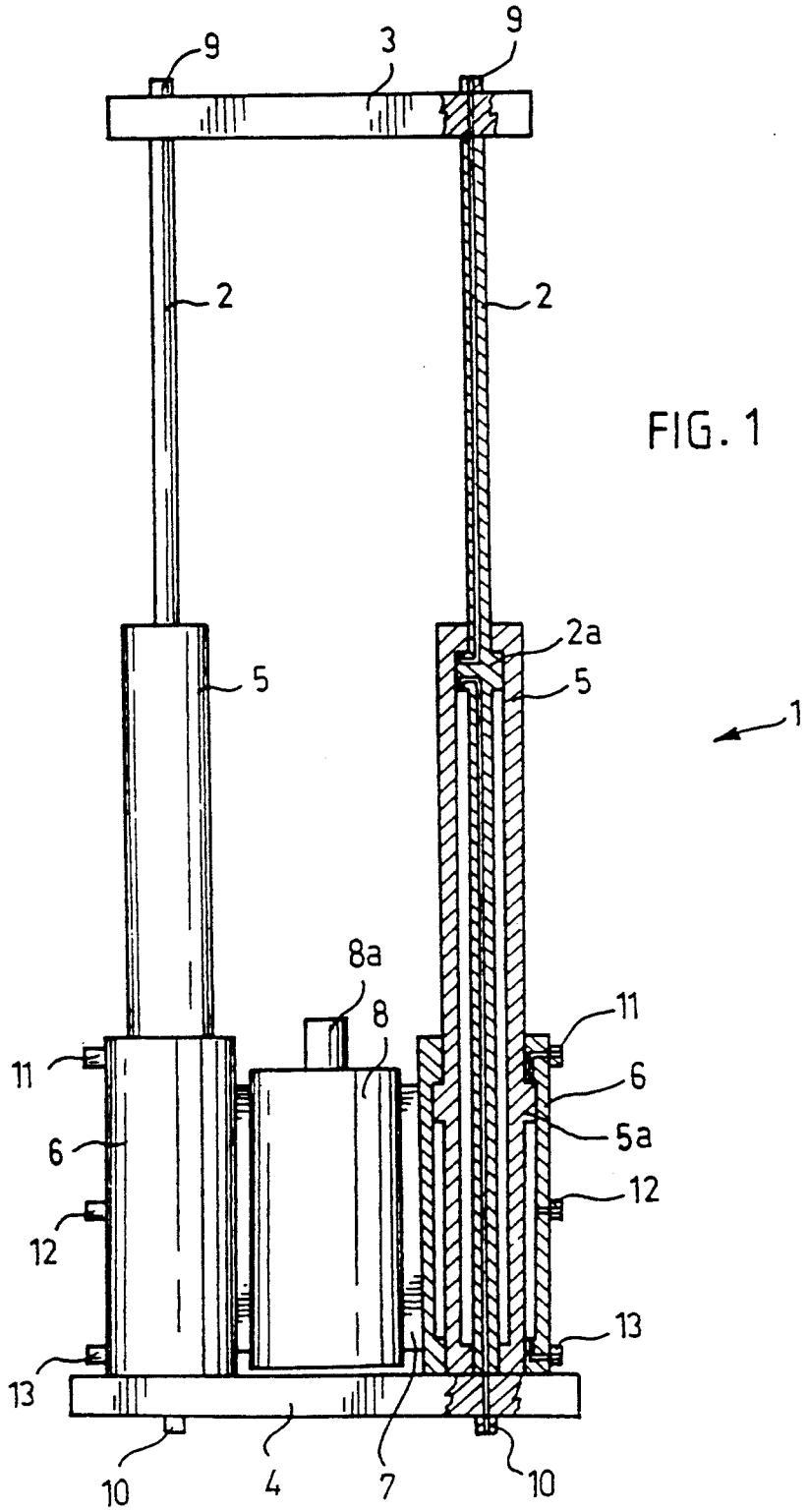

FIG. 1 shows a feeding apparatus 1 comprising two cylinder arrangement according to the invention, one of which is shown in section. Both feeding cylinders comprise a fixed piston rod 2 one end of which is connected to a body part 3 and the other end to another body part 4. Feeding cylinders 5 are arranged movably around the piston rods, and connecting cylinders 6 are arranged movably around the feeding cylinders. A carriage 7 is mounted between the connecting cylinders 6, which are positioned side by side, and a drilling machine 8 is attached to the carriage 7 between the connecting cylinders 6. The drilling machine may be connected to the connecting cylinder or cylinders through a carriage as described above or it may be connected directly to the cylinders. Both piston rods are provided with pressure fluid conduits 9 through which pressure fluid can be fed through the piston rod from its one end between a piston 2*a* attached to the piston rod and the feeding cylinder 5 to one side of the piston 2*a*. Correspondingly, the other end of each piston rod is provided with a pressure fluid conduit 10 through which pressure fluid can be fed between the piston 2*a* and the feeding cylinder 5 to the other side of the piston 2*a*. The connecting cylinder 6 comprises three pressure fluid conduits 11, 12 and 13, through which pressure fluid can be fed between the connecting cylinder 6 and a second piston 5*a* formed on the outside of the feeding cylinder 5, or mounted fixedly with respect to it, to either side of the second piston, and correspondingly removed therefrom.

The cylinders of the apparatus operate in the following way. When pressure fluid is fed in the position shown in FIG. 1 through the conduit 11 into the connecting cylinder 6, the cylinder is displaced with respect to the feeding cylinder 5 upwards in the figure while pressure fluid is discharged through the conduit 12 or 13 or both. If pressure fluid is able to pass through the conduit 12 only, the movement stops when the conduit 12 reaches the piston 5*a*. The movement length of the drilling machine 8 can thereby be adjusted so that it corresponds to the length of one connecting thread of the drill pipe by dimensioning the length of the cylinder 6 so that it is at least two times the length of the connecting thread 14*c*. If the pressure fluid is still allowed to escape through the conduit 13 and the conduit 12 is closed, the connecting cylinder 6 is displaced further with respect to the feeding cylinder 5 until the lower end of the cylinder 6 in the figure stops at the piston 5*a* of the feeding cylinder 5. Correspondingly, when the connecting cylinder 6 is displaced in the opposite direction by feeding pressure fluid through the conduit 13, the drilling machine 8 can be displaced backwards over a distance corresponding to at least one thread length at a time without the feeding cylinder 5 moving away from the position shown in FIG. 1. The feeding cylinder 5 in turn can be displaced from the position shown in FIG. 1 upwards in the figure by feeding pressure fluid through the conduit 9 between the feeding cylinder 5 and the piston 2*a* of the piston rod 2 while pressure fluid is allowed to escape through the conduit 10. Correspondingly, the feeding cylinder 5 can be displaced in the opposite direction by feeding pressure fluid through the conduit 10 and by allowing it to escape through the conduit 9.

Figures 2A, 2B, 2C, 2D, 2E:
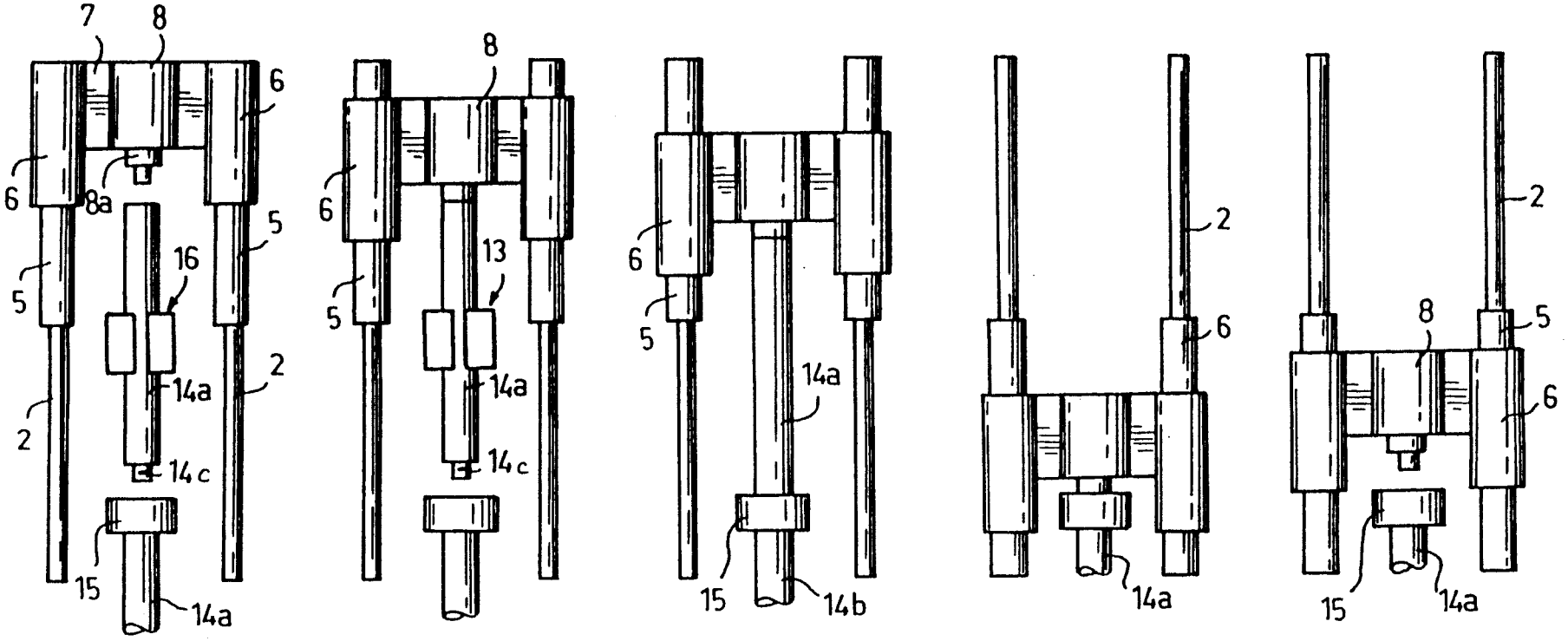

FIGS. 2*a* to 2*e* illustrate schematically in a simplified way the operation of the feeding apparatus according to the invention during drilling. FIG. 2*a* shows the feeding apparatus when a new drill pipe 14*a* is to be added to a drill string 14*b*. The connecting cylinders 6 are in their farthest position with respect to the feeding cylinders 5, and the feeding cylinders 5 are correspondingly in their backmost position so that the drilling machine 8 and a shank 8*a* attached to it are as far as possible form the drill string 14*b*. The new drill pipe 14*a* can thereby be fitted between the shank 8*a* of the drilling machine 8 and the drill string 14*b* and its retaining means 15. The drill pipe 14*a* is displaced between the shank and the drill string 14*b* to the drilling axis by means of a displacing device (not shown) obvious to one skilled in the art. While the displacing device holds the drill pipe 14*a*, the connecting cylinders 6 are displaced onwards, that is, downwards in FIG. 2*a*, while the shank 8*a* of the drilling machine is rotated, so that it is screwed on the thread 14*c* of the drill pipe 14*a* and thus becomes engaged with it after it has moved over one half of its movement length, as shown in FIG. 2*b*. Thereafter the displacing device 16 is detached from the drill pipe 14*a* and the connecting cylinders 6 are again displaced onwards. The displacement of the connecting cylinders and the rotation of the shank 8*a* of the drilling machine cause the drill pipe to be screwed on the thread 14*c* of the drill string 14*b* while the retaining means 15 holds it. After the cylinders 6 have been displaced onwards into their extreme position, the new drill pipe 14*a* has been connected both to the drilling machine and to the preceding drill string 14*b*, as shown in FIG. 2*c*. At this stage the retaining means 15 is released and the drilling machine 8 is displaced onwards by means of the feeding cylinders 5 and a hole is drilled until the feeding cylinders 5 are in their foremost position with respect to the piston rods 2, as shown in FIG. 2*d*. The situation is now the same as before FIG. 2*a*. At this stage the drill pipe 14*a* is gripped by means of the retaining means 15 and the shank of the drilling machine 8 is rotated in a direction opposite to the drilling direction while the connecting cylinders 6 are displaced backwards with respect to the feeding cylinders 5, so that the thread coupling between the shank 8*a* and the drill pipe 14*a* is released, as shown in FIG. 2*e*. The drilling machine is then displaced by means of the feeding cylinders 5 and the connecting cylinders 6 to its backmost position, FIG. 2*a*, and the operation continues through similar steps as above. To disengage a drill pipe, the steps are performed in reverse order and the movements of the cylinders are reversed.

The invention has been described above and in the figures schematically and by way of example and it is in no way restricted to it. There may be only two pressure fluid conduits provided in the connecting cylinders, so that the movement of the cylinder can be stopped in the middle by means of a sensor which indicates when the middle point is positioned at the piston 5*a*.

I claim:

1. Drill pipe handling apparatus for use with a plurality of drilling pipes each having a thread length at an end thereof comprising:

at least one feed cylinder and a piston therein having a two-sided piston rod and pressure fluid conduits for feeding pressure fluid into pressure fluid spaces in the at least one feed cylinder on opposite sides of said piston, the at least one feed cylinder being mounted in the handling apparatus such that the piston is longitudinally immovable with respect to the handling apparatus and the at least one feed cylinder is movable in a feed direction with respect to the piston;

a second piston immovable relative to the at feed least one feed cylinder;

a separate connecting cylinder displaceable in the longitudinal direction of the at least one feed cylinder with respect to the second piston and the at least one feed cylinder, said second piston and said connecting cylinder being arranged about the at least one feed cylinder;

pressure fluid conduits separate from the pressure fluid conduits of the at least one feed cylinder for feeding pressure fluid into pressure fluid spaces in the connecting cylinder on opposite sides of the second piston for displacing the connecting cylinder with respect to the at least one feed cylinder;

a drilling machine connected to the connecting cylinder;

the connecting cylinder having a stroke at least two times the thread length of the drill pipe, the connecting cylinder including an additional pressure fluid conduit positioned substantially medially of the length of stroke of the connecting cylinder relative to the at least one feed cylinder for stopping the movement of the connecting cylinder when the second piston reaches said additional pressure fluid conduit.

2. Apparatus according to claim 1 including means for opening the additional pressure fluid conduit of said connecting cylinder and for closing one pressure fluid conduit to the connecting cylinder while feeding pressure fluid to the connecting cylinder by another of said pressure fluid conduits.

* * * * *